US005805185A

United States Patent [19]

Kondo

[11] Patent Number: 5,805,185

[45] Date of Patent: Sep. 8, 1998

[54] BACK ELECTRODE CONTROL DEVICE AND METHOD FOR AN IMAGE FORMING APPARATUS WHICH VARIES AN ELECTRIC POTENTIAL APPLIED TO THE BACK ELECTRODE BASED ON THE NUMBER OF DRIVEN APERTURE ELECTRODES

[75] Inventor: Takeshi Kondo, Nagoya, Japan

[73] Assignee: Brother Kogyo Kabushiki Kaisha, Nagoya, Japan

[21] Appl. No.: 350,049

[22] Filed: Nov. 29, 1994

[30] Foreign Application Priority Data

Dec. 24, 1993 [JP] Japan ..... 5-327000

[51] Int. Cl.[6] ..... B41J 2/06

[52] U.S. Cl. ..... 347/55; 347/112

[58] Field of Search ..... 347/55, 112, 141, 347/151, 142–144, 190, 12, 13; 400/120.1

[56] References Cited

U.S. PATENT DOCUMENTS

| | | | |
|---|---|---|---|
| 3,689,935 | 9/1972 | Pressman et al. | 347/55 |
| 4,491,855 | 1/1985 | Fujii et al. | 347/55 |
| 4,743,926 | 5/1988 | Schmidlin et al. | 347/55 |
| 4,755,837 | 7/1988 | Schmidlin et al. | 347/55 |
| 4,780,733 | 10/1988 | Schmidlin | 347/55 |
| 4,814,796 | 3/1989 | Schmidlin | 347/55 |
| 4,912,489 | 3/1990 | Schmidlin | 347/55 |
| 4,967,205 | 10/1990 | Sakaguchi et al. | 347/190 |
| 5,036,341 | 7/1991 | Larsson | 347/55 |
| 5,404,155 | 4/1995 | Kitamura | 347/151 |
| 5,497,175 | 3/1996 | Maeda | 347/55 |
| 5,517,229 | 5/1996 | Gunther | 347/190 |

FOREIGN PATENT DOCUMENTS

| | | |
|---|---|---|
| 0 587 366 | 3/1994 | European Pat. Off. . |

*Primary Examiner*—N. Le
*Assistant Examiner*—Charlene Dickens
*Attorney, Agent, or Firm*—Oliff & Berridge, PLC

[57] ABSTRACT

An image forming apparatus includes a toner supporting roller, an aperture electrode assembly including one or more apertures and associated control electrodes, a controller and a back electrode roller. The toner supporting roller supplies charged toner particles to the underside of the apertures of the aperture electrode assembly. The controller selectively generates a potential difference between each of the control electrodes and the toner supporting roller. A coulomb force generated by the potential difference attracts the toner particles towards the apertures of the aperture electrode assembly. When no voltage is applied to the control electrodes in generating a blank line, no voltage or a reverse voltage is fed to the back electrode roller. Thus, undesired toner particles are not inadvertently transferred to a printing paper, such that blank image areas spattered with unintentionally transferred toner particles are minimized.

21 Claims, 7 Drawing Sheets

BACK ELECTRODE CONTROL DEVICE AND METHOD FOR AN IMAGE FORMING APPARATUS WHICH VARIES AN ELECTRIC POTENTIAL APPLIED TO THE BACK ELECTRODE BASED ON THE NUMBER OF DRIVEN APERTURE ELECTRODES

BACKGROUND OF THE INVENTION

1. Field of the Invention

This invention relates to an image forming apparatus for use in copiers, printers, plotters, facsimile machines and the like. In particular, this invention relates to a device and method for controlling a potential applied to a back electrode of an image forming apparatus.

2. Description of Related Art

U.S. Pat. No. 3,689,935 describes an image forming apparatus wherein driving signals representing image signals are applied to an aperture electrode assembly having a plurality of small holes (called apertures) to control the passage of toner particles through the apertures. Having passed through the apertures, the toner particles are transferred under suitable control to form images on an image support medium (printing paper, etc.) set in the apparatus.

In the described image forming apparatus, the aperture electrode assembly comprises a reference electrode and a plurality of control electrodes, the reference electrode and the control electrodes sandwiching an insulating layer. The reference electrode is furnished on one side of the aperture electrode assembly and comprises a continuous conducting layer deposited on the insulating layer. The control electrodes are provided on the other side of the aperture electrode assembly, each including a conducting layer insulated alternately in the longitudinal direction. Each of the control electrodes has at least one row of apertures piercing the three layers. The image forming apparatus further comprises means such as a control electrode driving circuit for applying a potential between the control electrodes and the reference electrode, means for generating charged toner particles such that the charged toner particles will be accelerated under the applied potential and pass through the apertures, and means for moving the image support medium supporting a toner image relative to the aperture electrode assembly so as to position the image support medium suitably amid the flow of the toner particles.

Another conventional type of image forming apparatus is disclosed in U.S. Pat. Nos. 4,743,926, 4,755,837, 4,780,733 and 4,814,796. The disclosed type of apparatus has an aperture electrode assembly comprising a control electrode arrangement oriented toward the image support medium side and a reference electrode arrangement directed toward the toner supply side. This aperture electrode assembly includes a sheet made of an insulating material, the control electrode arrangement attached to the side of the sheet which faces the image support medium side, and the reference electrode arrangement mounted on the side of the sheet which faces the toner supply side.

U.S. Pat. No. 4,912,489 describes an image forming apparatus having an aperture electrode assembly made of a control electrode arrangement and a shielding electrode arrangement. The control electrode arrangement is mounted on the side of the assembly which faces the toner supply side, with the shielding electrode arrangement on the side of the assembly which faces the image forming medium side. A control circuit is connected interposingly between the shielding electrode arrangement and the control electrode arrangement. Given an image signal, the control circuit applies a voltage to the individual control electrodes corresponding to the image portion represented by the signal. Applying a voltage generates an electric field between the shielding electrode arrangement and the control electrode arrangement near the apertures corresponding to the image portion. The electric field transfers toner particles from the toner supporter to the opening of each applicable aperture which is on the toner supporting side, the particles then being drawn inside the apertures corresponding to the image portion. When the toner particles are inside the apertures, a back electrode connected a DC source causes the toner particles to move out of the apertures corresponding to the image portion so as to form an image on the image forming medium.

The '489 apparatus forms a blank image portion (with no toner particles transferred to the image support medium) in a specific manner. That is, unlike the apparatuses disclosed in the other U.S. patents cited above, the '489 image forming apparatus reduces the voltage applied to the control electrode arrangement when forming a blank image portion (i.e., at off-time) to about one-fourth of the voltage applied in forming a toner particle-filled image (i.e, at on-time).

However, the image forming apparatus described in U.S. Pat. No. 4,912,489 actually has only a limited difference in the selectively controlled amount of toner between two operations: transferring toner particles to the image support medium, and not transferring them. That is, a small amount of toner particles tends to be transferred to the image support medium even when such transfer is not desired. This leads to a distinct conventional disadvantage in that the toner particles may be transferred when transfer is not desired, thus producing a toner image spattered with toner particles over the image support medium.

Specifically, where an entire line constitutes a blank image portion (with no toner particles supposed to be transferred to form an image), the back electrode charged with a DC voltage can still cause a small amount of toner to migrate to the image support medium. This results in a reduced level of print quality because the blank image portion is spattered with the unintentionally transferred toner particles.

SUMMARY OF THE INVENTION

This invention therefore provides an image forming apparatus capable of high-quality printing by eliminating unintentionally transferred toner particles in the blank image portion over the image support medium.

This invention further provides a method and apparatus for controlling the electric potential applied to the back electrode.

In achieving the foregoing and other objects of the invention, and according to one aspect of this invention, an image forming apparatus is provided which comprises toner flow control means including a plurality of apertures, each aperture having an electrode; toner supply means for supplying toner to the underside of the apertures of the toner flow control means; a back electrode located opposite to the toner supply means across the toner flow control means; electrode driving means for individually controlling the potential of each electrode attached to the toner flow control means, thereby transferring the toner selectively from the toner supply means through the apertures of the toner flow control means toward the back electrode; and back electrode control means for varying the potential difference between the back electrode and the toner supply means in accordance with the number of the electrodes driven by the electrode driving means.

In a first preferred embodiment of this invention, the back electrode control means reduces the potential difference between the back electrode and the toner supply means to zero when the electrode driving means functions to inhibit all electrodes from transferring the toner.

In a second preferred embodiment of this invention, the electric potential applied to the back electrode when forming at least one image portion is varied based on the number of image portions to be formed.

In a third preferred embodiment, the back electrode control means reverses the potential difference between the back electrode and the toner supply means when the electrode driving means functions to inhibit all electrodes from transferring the toner.

In operation, the image forming apparatus of this invention controls the toner supply means to supply charged toner to the underside of the apertures of the toner flow control means, while the electrode driving means selectively generates a potential difference between each of the electrodes and the toner supply means. The Coulomb force stemming from the potential difference attracts the toner toward the apertures of the electrodes that are turned on. The back electrode control means selectively generates a potential difference between the toner supply means and the back electrode in accordance with the number of active electrodes (i.e., the electrodes driven by the electrode driving means) to generate the potential difference between each electrode and the toner supply means. An electric field generated by the back electrode attracts the toner particles for transfer through the air towards the back electrode, causing the toner to be placed onto the image support medium. The process makes it possible to minimize undesirable toner particles which spatter in the blank image portions.

As outlined, the image forming apparatus of this invention has the back electrode control means generate, between the toner supply means and the back electrode, the potential difference corresponding to the number of the electrodes driven by the electrode driving means. The toner drawn out of the apertures of the toner flow control means is transferred through the air toward the back electrode by its electric field, the transferred toner being placed onto the image support medium. Because the amount of unintentionally transferred toner particles spattered in blank image portions is kept to a minimum, (i.e., because the blank image portions on the image support medium remain free of the undesirable toner particles), the invention ensures printing of high quality.

These and other objects, features and advantages of the invention will become more apparent upon a reading of the following description and appended drawings.

BRIEF DESCRIPTION OF THE DRAWINGS

The preferred embodiments of this invention will be described in detail with reference to the following figures, wherein.

DETAILED DESCRIPTION OF THE PREFERRED EMBODIMENT

Figure 1:
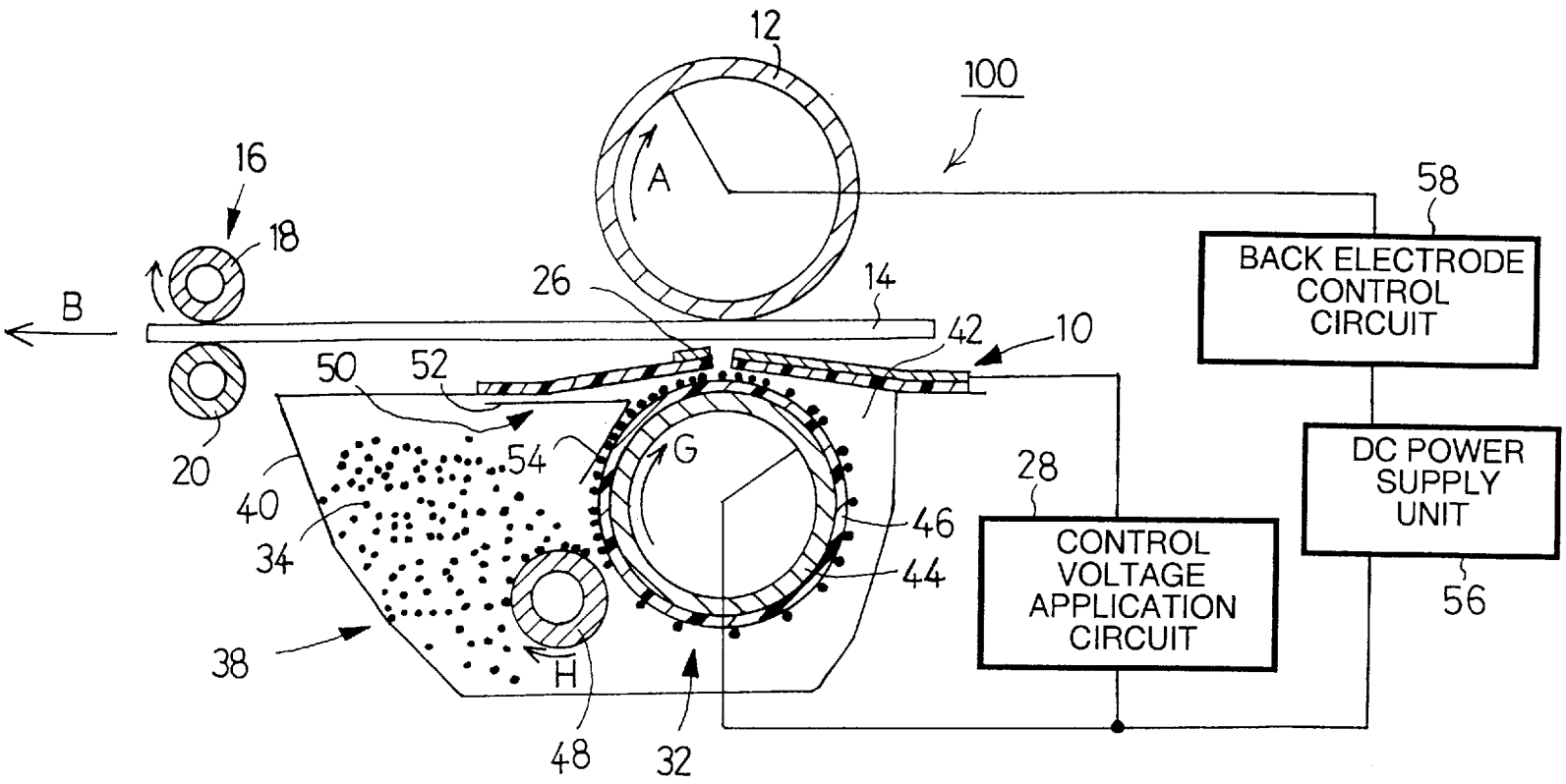
FIG. 1 is a cross-sectional view of a first preferred embodiment of the image forming apparatus.

A first preferred embodiment of the invention will be described with reference to the accompanying drawings. FIG. 1 schematically shows the first preferred embodiment of the image forming apparatus 100. A cylindrical back electrode roller 12, which is rotatably supported by a frame (not shown), is positioned approximately 1 mm above an aperture electrode assembly 10, which acts as a toner flow control means. The back electrode roller 12 is rotated in the direction indicated by arrow A by a driving device (not shown).

A printing paper 14, which serves as an image support medium, is fed through the 1 mm gap between the aperture electrode assembly 10 and the back electrode roller 12. A paper feeder (not shown) feeds the printing paper 14 to the position where the paper contacts the underside of the back electrode roller 12. In the paper feed direction, indicated by arrow B, a fixing device 16 is furnished downstream of the back electrode roller 12. The fixing device 16, which includes a heating roller 18 and a support roller 20, heats the printing paper 14 to fix the image.

Figure 2:
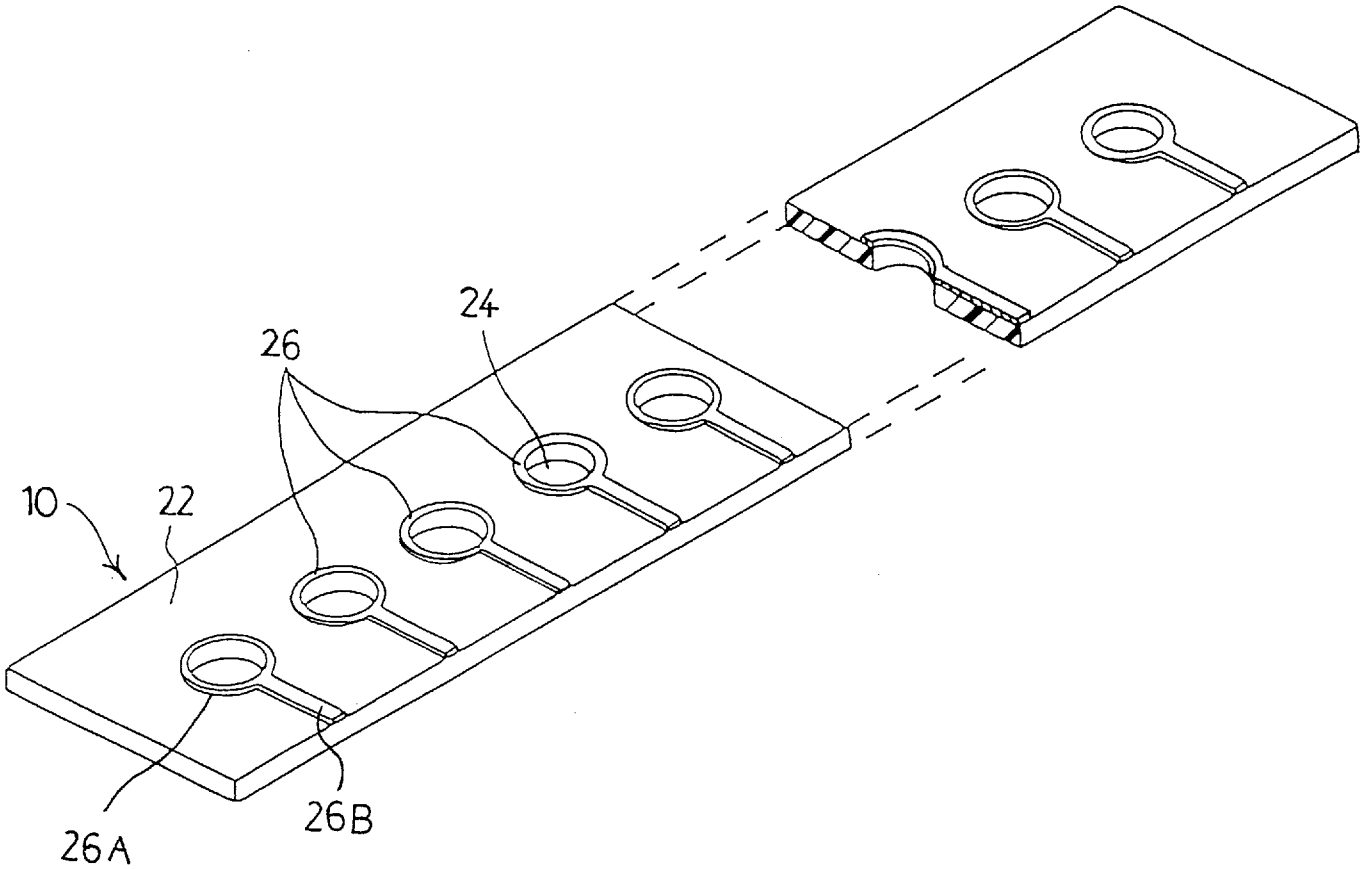
FIG. 2 is a perspective view of a first preferred embodiment of the aperture electrode assembly.

The aperture electrode assembly 10 is shaped like a belt, as shown in FIG. 2. The assembly 10 has a plurality of apertures 24, each measuring approximately 100 $\mu$m in diameter, which are formed in a longitudinal row along an insulating sheet 22. The insulating sheet 22 has a thickness of approximately 25 $\mu$m and is made of polyimide. The apertures 24 pierce the insulating sheet 22. The control electrodes 26 are positioned on top of the insulating sheet 22 and are approximately 1 $\mu$m thick and are formed of a metal such as copper or gold. Each control electrode 26 comprises an electrode part 26A and a lead part 26B. The electrode part 26A is circular in shape around the aperture 24, while the lead part 26B connects the electrode part 26A to a control voltage application circuit 28, which is shown in FIG. 1. The approximately 25 $\mu$m thick polyimide sheet is used as the insulating sheet 22, because an insulating sheet any thinner than this makes mounting the control electrodes 26 and their associated parts on the insulating sheet difficult.

The aperture electrode assembly 10 is attached to a toner case 40 of a toner supply unit 38 of the image forming apparatus 100, as illustrated in FIG. 1. The top wall of the toner case 40 is provided with an opening 42 extending perpendicularly to the feed direction of the printing paper 14. The aperture electrode assembly 10 is arranged so that the control electrodes 26 face away from the toner case 40 and such that the longitudinal direction of the aperture electrode assembly 10 is also perpendicular to the feed direction of the printing paper 14.

Inside the toner case 40 is a toner supporting roller 32, which is rotatably attached to a shaft, (not shown) which is positioned perpendicularly to the paper feed direction B, as depicted in FIG. 1. A driving device (not shown) rotates the toner supporting roller 32 in the direction indicated by arrow G. The toner supporting roller 32 comprises a supporter electrode 44 whose surface is covered with an insulating layer 46. The supporter electrode 44 is made of a metal such as copper or aluminum, and the insulating layer 46 is formed of polyimide and has a thickness of approximately 10 $\mu$m. Inside the toner case 40, the toner supporting roller 32 is positioned to contact the control electrodes 26 of the aperture electrode assembly 10 and to push up the aperture electrode assembly 10 so that the electrode assembly 10 will slightly protrude from the top of the toner case 40.

The toner case 40 contains toner particles 34 downstream of the toner supporting roller 32 in the paper feed direction.

The toner particles 34 have an electrically insulating property and are supplied by a toner supply roller 48 to the toner supporting roller 32. The toner supply roller 48, which is approximately the same in length as the toner supporting roller 32, is rotatably supported by a shaft (not shown) positioned in parallel with the rotating axis of the toner supporting roller 32. A driving device (not shown) rotates the toner supply roller 48 in the direction indicated by arrow H to frictionally transfer the toner particles 34 onto the toner supporting roller 32.

Also inside the toner case 40 is a toner layer limiting blade 50, which is located above the toner supply roller 48. The toner layer limiting blade 50 has a V-shaped cross section and is approximately equal in length to the toner supporting roller 32. One plate portion 52 of the toner layer limiting blade 50 is fixed to the toner case 40 and the other plate portion 54 extends tangentially to the toner supporting roller 32 and to elastically contact the toner supporting roller 32.

Figure 3:
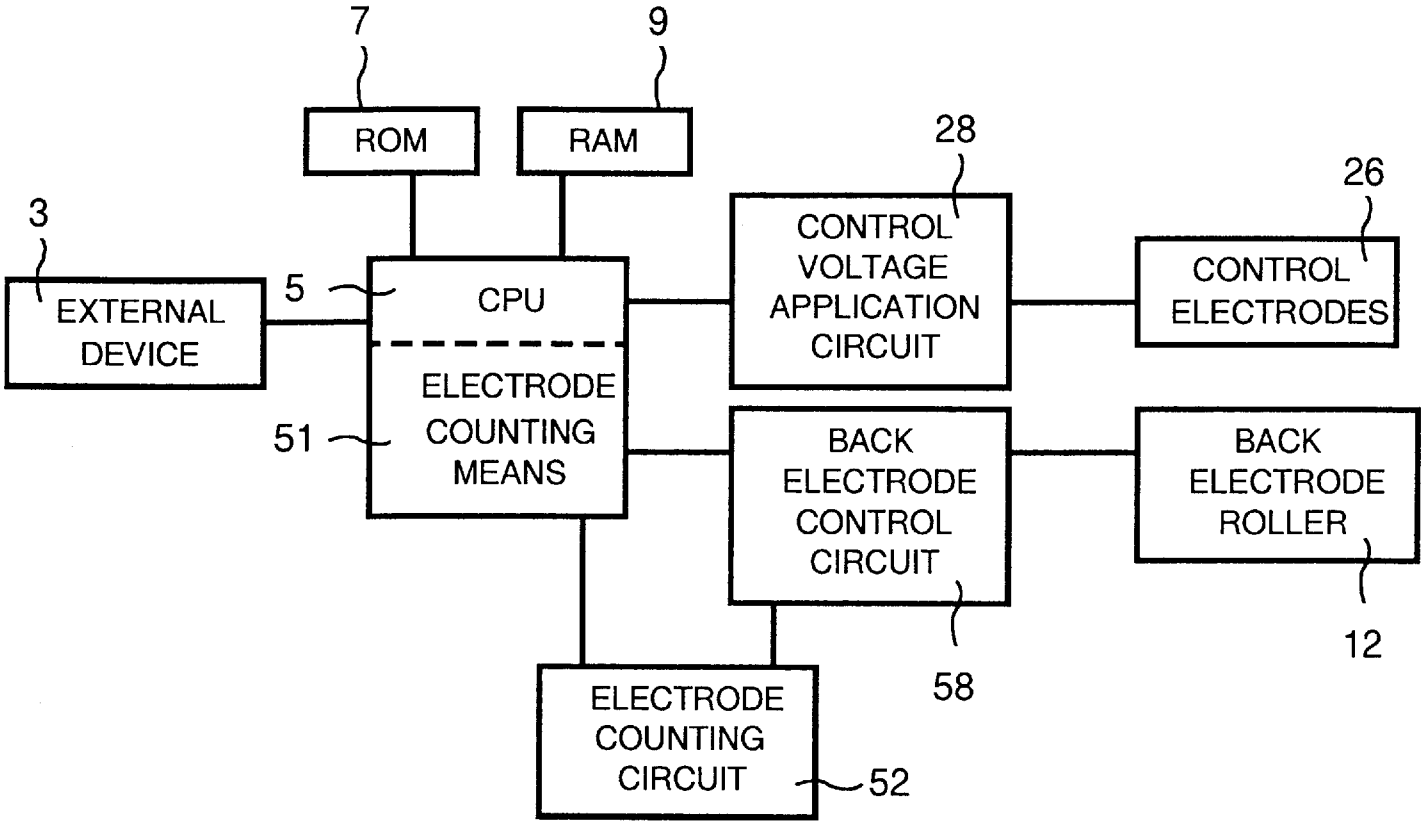
FIG. 3 is a block diagram of the control system of the image forming apparatus.
Figure 4:
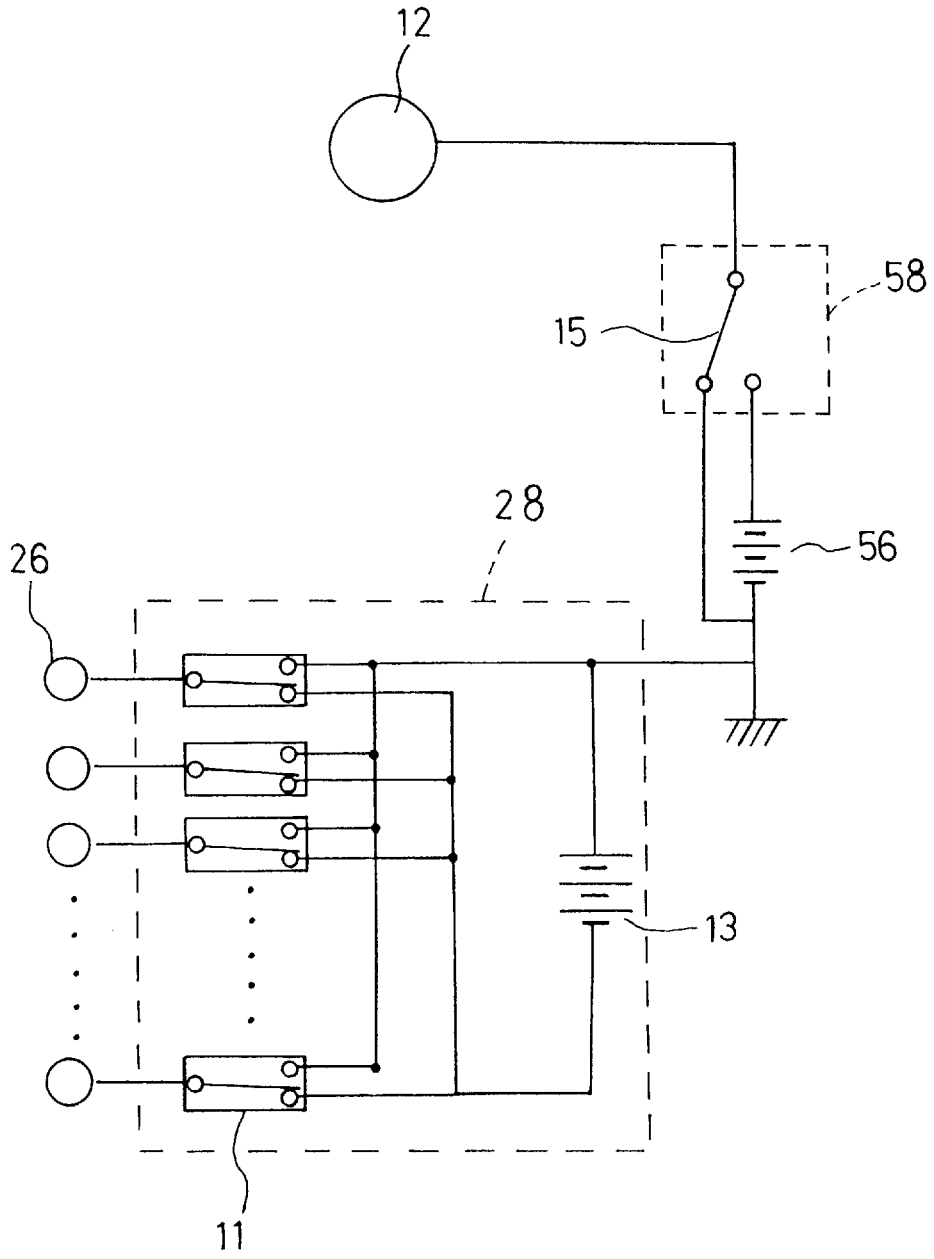
FIG. 4 is a schematic diagram of the control voltage application circuit and the back electrode control circuit.

A DC power supply unit 56 is connected via a back electrode control circuit 58 between the back electrode roller 12 and the supporter electrode 44 of the toner supporting roller 32. The control voltage application circuit 28 is connected between the control electrodes 26 and the supporter electrode 44. As shown in FIG. 3, an image signal input from an external device 3 is stored in a RAM 9 via a control means (CPU) 5. The image signal is then output via the control means 5 to the back electrode control circuit 58 and control voltage application circuit 28. As illustrated in FIG. 4, the back electrode control circuit 58 comprises a switching device 15. The switching device 15 can comprise any conventional switch, including electromechanical switches, electrical switches, and electronic switches. Preferably, the switching devices 15 are transistors. Based on the image signal, the control means 5 causes the back electrode control circuit 58 with its switching device 15 to apply a voltage of +1 kV or 0V to the back electrode roller 12. The control voltage application circuit 28 comprises a DC power supply 13 and a plurality of switching devices 11. Each switching device 11, as depicted in FIG. 4, can comprise any conventional switch, including electromechanical switches, electrical switches, and electronic switches. Preferably, the switching devices 11 are transistors. Based on the image signal, the control means 5 causes the control voltage application circuit 28 to apply a voltage of 50 V or 0 V to the control electrodes 26.

The operation of the image forming apparatus 100 described above will now be described with reference to FIG. 1. When power is applied and image forming data is sent in, the toner supporting roller 32 and the toner supply roller 48 rotate in the directions indicated by the arrows G and H, respectively. This frictionally transfers the toner particles 34 from the toner supply roller 48 onto the toner supporting roller 32. Once on the toner supply roller 32, the toner particles 34 are negatively charged. The toner particles 34 thus carried by the toner supporting roller 32 are turned into a thin layer by the toner layer limiting blade 50. After being further charged, the thin layer of toner particles 34 is transferred by rotation of the toner supporting roller 32 toward the aperture electrode assembly 10. The toner particles 34 on the toner supporting roller 32 are frictionally transferred onto the aperture electrode assembly 10 while being fed to the underside of the apertures 24.

Based on the image forming data from the control means 5, the control voltage application circuit 28 now applies a voltage of +50 V to those control electrodes 26 which correspond to the image portions (i.e., the portions to be provided with toner particles) in the currently printing line.

As a result, the potential difference occurring between the control electrodes 26 and the toner supporting roller 32 generates electric lines of force near those apertures 24 which correspond to the image portions. The electric force lines extend from the control electrodes 26 to the toner supporting roller 32. The intensity of the electric force lines so generated is directly proportional to the potential difference between the control electrodes 26 and the toner supporting roller 32 and inversely proportional to the distance between them.

The electric force lines which extend from the control electrodes 26 to the toner supporting roller 32 subject the negatively charged toner particles 34 to the Coulomb force in the direction of higher potential. The toner particles 34 are thus attracted from the toner supporting roller 32 through the apertures 24 towards the control electrodes 26.

The control voltage application circuit 28 applies the voltage of 0V to those control electrodes 26 which correspond to blank image portions (i.e., the portions not to be provided with toner particles). This means that no electric field is generated between the toner supporting roller 32 and the control electrodes 26. Without being subject to the electrostatic Coulomb force, the toner 34 on the toner supporting roller 32 remains there and does not pass through the apertures 24.

Figure 5:
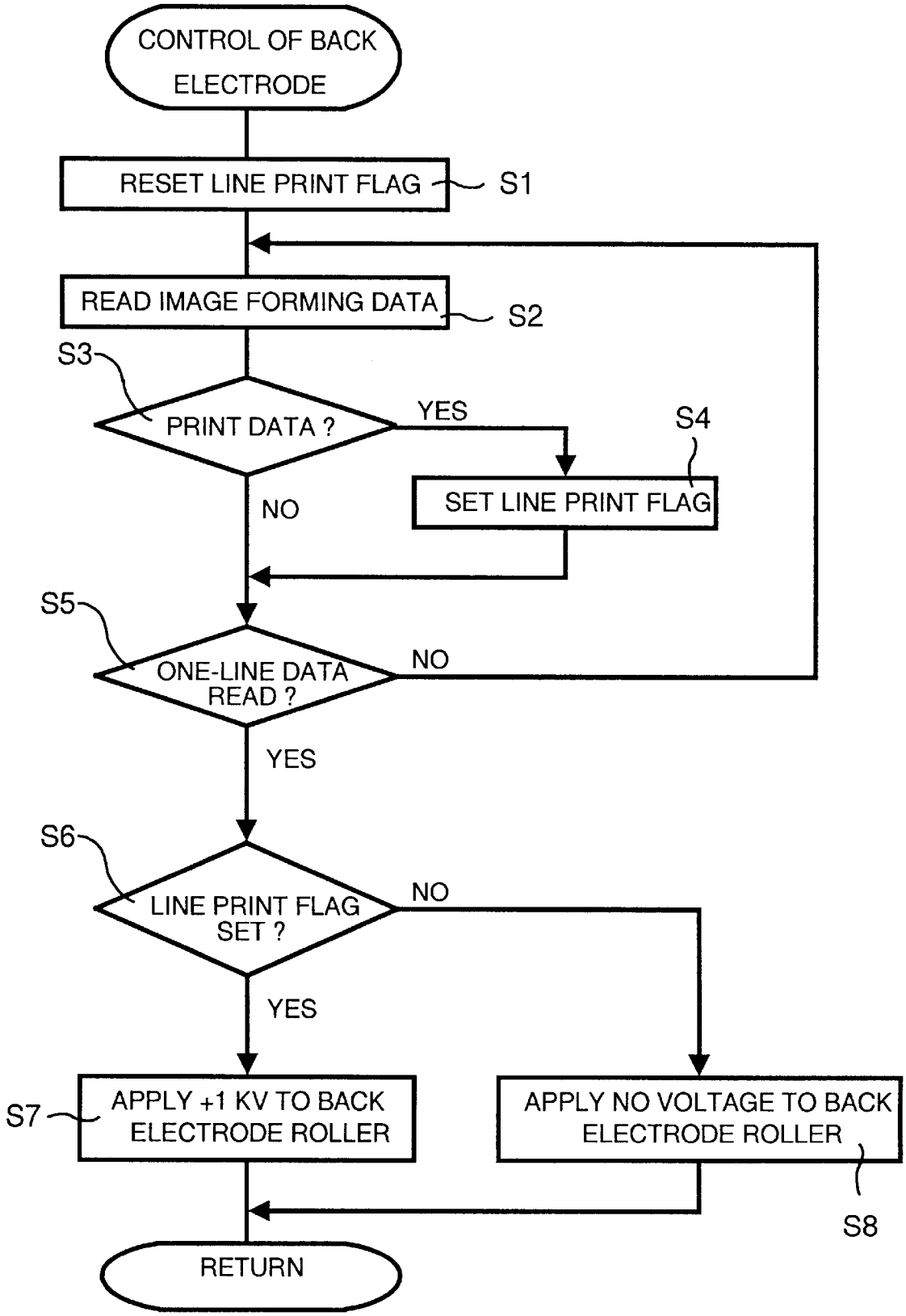
FIG. 5 is a flowchart of steps for controlling a back electrode roller included in the embodiment.

At the same time, the control means 5 controls the back electrode roller 12 as outlined in the flow chart of FIG. 5. First, in step S1, the Line Print flag within the control means 5 is reset.

Next, in step S2, the CPU 5 reads the next section of image forming data from the external device 3. In step S3, the CPU 5 checks the input image forming data to determine if it is print data. If the image forming data is print data, control continues to step S4. In step S4, the Line Print flag is set. Otherwise, control jumps directly to step S5. That is, even if the image portion has at least a single dot, control continues from step S3 to step S4, rather than jumping directly to step S5. In step S5, the CPU 5 determines if a line of print data has been read. If one line of data has been read, control continues to step S6. Otherwise, if the read image data is not a line of print data, control jumps back to step S2, where the next section of image data is read.

In step S6, the CPU 5 determines if the Line Print flag is set. If, in step S6, the CPU 5 determines the Line Print flag is set, i.e., that the line contains any image portion made of at least one dot, control continues to step S7. Otherwise, if the CPU 5 determines that the Line Print flag is not set, control jumps to step S8.

In step S7, a voltage of +1 kV is applied to the back electrode roller 12. The application of the +1 kV voltage to the back electrode roller 12 attracts the toner particles 34 toward the control electrodes 26. The toner particles 34 are further transferred through the air to the printing paper 14 by the electric field formed between the printing paper 14 and the aperture electrode assembly 10 because of the voltage applied to the back electrode roller 12. The toner particles 34 thus transferred settles on the printing paper 14 to form picture elements on the printing paper 14.

Every time one column of picture elements is formed by the toner particles 34 on the printing paper 14, the printing paper 14 is fed by one picture element in the feed direction B.

In contrast, in step S8, when the Line Print flag is reset and with the current line containing no image portion, no voltage is applied to the back electrode roller 12. Because no electric field is generated between the printing paper 14 and the aperture electrode assembly 10, the toner particles 34 are not unintentionally transferred through the air. The current line is thus completely blank with no undesirable toner particles 34 spattered onto the printing paper 14. As a result, high-quality printing is achieved. Alternately, a negative voltage is applied to the back electrode roller 12. Thus, if the toner particles are positively charged, a voltage of −1 kV is applied in step S7, and either a positive voltage or 0V is applied in step S8.

As the above process is repeated for each line, the toner image is formed over the entire surface of the printing paper 14. The toner image thus formed is fixed onto the printing paper 14 by the fixing device 16.

As described above, the image forming apparatus 100 of this invention does not apply any voltage to the back electrode roller 12 if the current line has no image portion. With no electric field generated between the printing paper 14 and the aperture electrode assembly 10, undesirable toner particles 34 are not unintentionally transferred through the air to be spattered on the printing paper 14. The line is completely blank as required, so that printing of high quality is ensured.

Although the description above contains many specificities, these should not be construed as limiting the scope of this invention, but merely as providing illustrations of the presently preferred embodiment.

For example, the above embodiment allows the control means 5 to apply the voltage of +1 kV to the back electrode roller 12 depending on whether the currently printing line has any image portion. Alternatively, the control means 5 may count the number of the control electrodes 26 which are being driven by the control voltage application circuit 28 to transfer the toner particles 34 through the air, in order to vary the potential of the back electrode roller 12 based on the count of active control electrodes 26 thus obtained. In this embodiment, a further electrode counting means 51 is incorporated into the CPU 5, or an electrode counting circuit 52 is incorporated into the control circuit, as shown in FIG. 3.

More specifically, in this second preferred embodiment, higher levels of potential are applied to the back electrode roller 12 as the number of control electrodes 26 driven for each column of apertures increases. It follows that the amount of toner particles 34 transferred through the air is varied for each driven control electrode 26, depending on the number of control electrodes 26 simultaneously activated. Ultimately, if all of the control electrodes 26 are driven to transfer toner particles 34, only the required amount of toner is transferred; if none of the control electrodes 26 is driven, the phenomena of toner particles 34 being unintentionally transferred are minimized. In this manner, the undesirable toner particles 34 spattered in the blank image portions are substantially reduced. Additionally, the number of activated control electrodes 26 which corresponds to the maximum electric potential applied to the back electrode can be either all of the control electrodes 26, or less than all of the control electrodes.

Figure 6A:
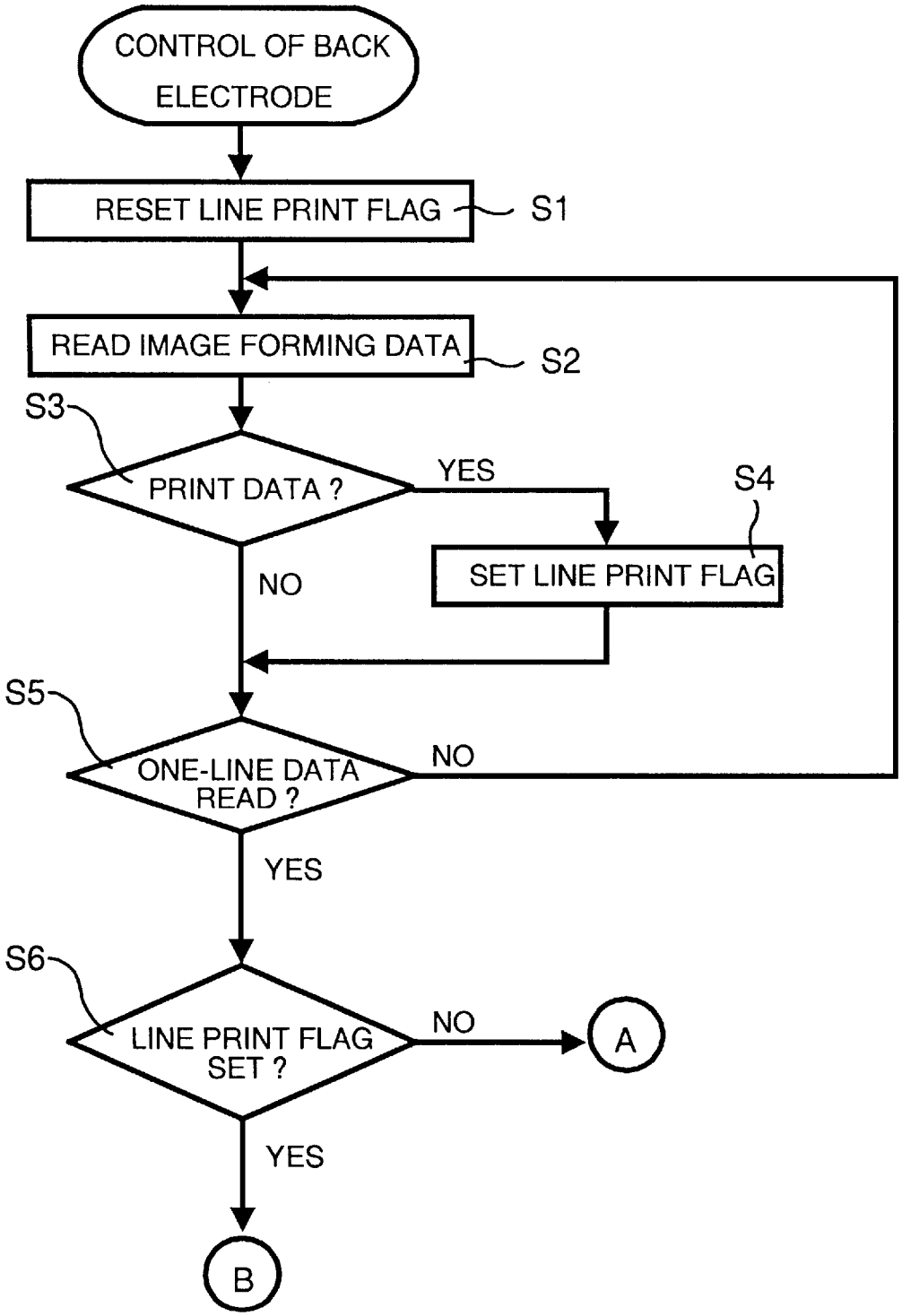
FIGS. 6A and 6B are a flowchart of a second preferred embodiment for controlling the control voltage application circuit.
Figure 6B:
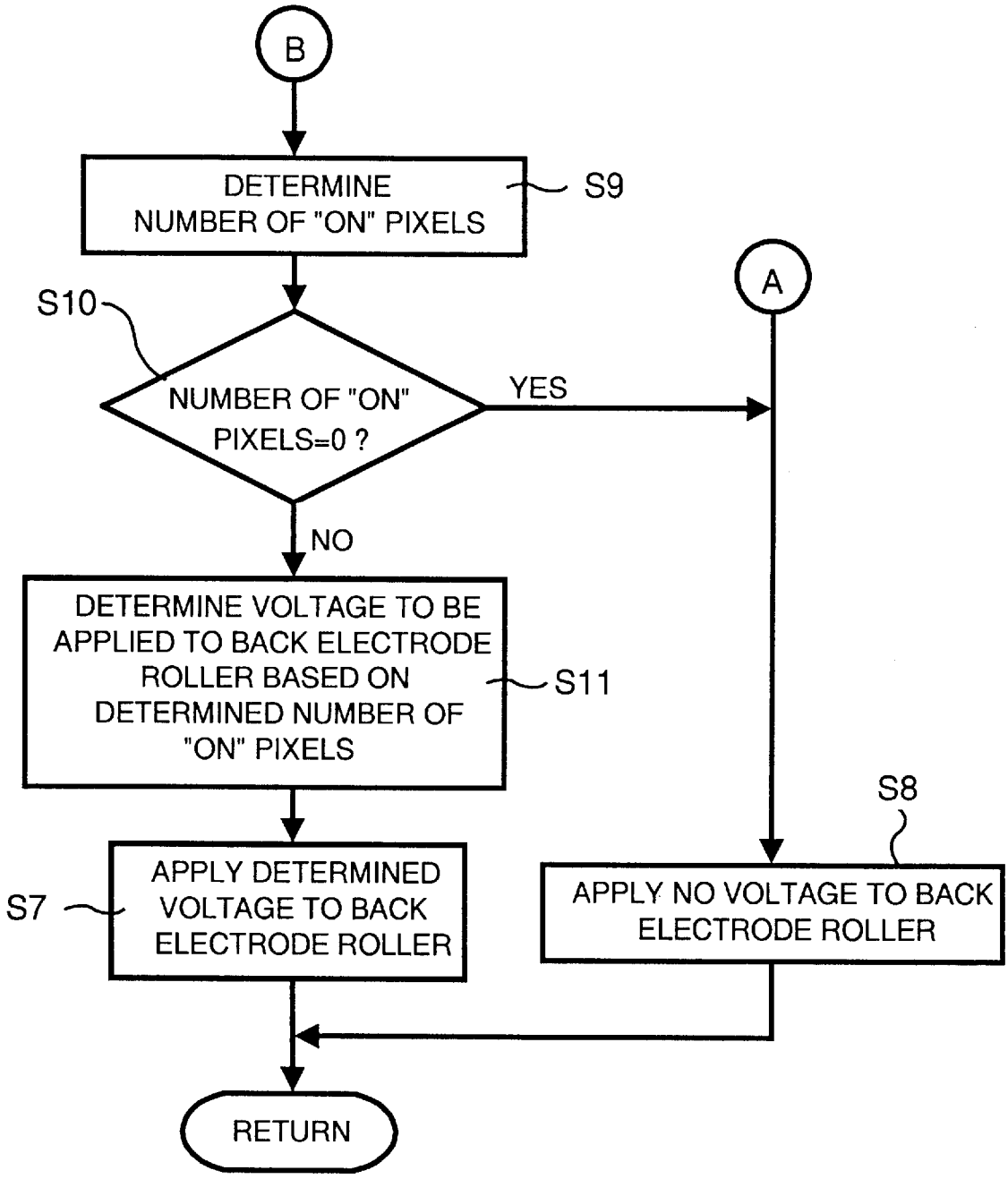

Thus, as shown in FIGS. 6A and 6B, which shows a slightly modified version of the flowchart of FIG. 5, if the Line Print flag is set, control jumps from step S6 to step S9, where the number of "on" control electrodes 26 is determined. Then, in step S10, if the number of "on" control pixels is zero, control jumps to step S8. Otherwise, control jumps to step S11, where the control voltage to be applied to the back electrode roller 12 is determined. Then, control jumps to step S7, where the determined control voltage is applied to the back electrode roller.

In the above embodiments, no voltage is applied to the back electrode roller 12 when none of the control electrodes 26 is driven. Alternatively, in a third preferred embodiment, the voltage for aerial transfer of toner particles 34 may be either reduced to a low level or reversed only when all control electrodes 26 remain undriven; if even a single control electrode 26 is to be driven, the potential of the back electrode roller 12 may be held at a constant level, or varied based on the number of driven electrodes, so as to transfer the toner particles 34 through the air.

Also in the above embodiments, the back electrode roller 12 is located opposite to the toner supporting roller 32 across the aperture electrode assembly 10. Alternatively, the back electrode roller 12 may be located elsewhere as long as it is fed with a voltage for suitably attracting toner particles 34 to the image support medium 14 interposed between the aperture electrode assembly 10 and the back electrode roller 12.

Thus, the scope of the invention should be determined by the appended claims and their legal equivalents, rather than by the examples given.

What is claimed is:

1. An image forming apparatus, comprising:

toner flow control means for controlling a flow of toner to an image recording medium, including a plurality of apertures, each aperture having an aperture electrode;

toner supply means for supplying toner to said toner flow control means;

a back electrode located on an opposite side of said toner supply means from said toner flow control means;

electrode driving means for individually controlling an electric potential of each of said aperture electrodes of said toner flow control means to transfer said toner selectively from said toner supply means through at least one aperture toward said back electrode; and back electrode control means for varying a potential difference between said back electrode and said toner supply means in accordance with a number of the aperture electrodes driven by said electrode driving means.

2. The image forming apparatus according to claim 1, wherein said back electrode control means reduces the potential difference between said back electrode and said toner supply means to zero when said electrode driving means functions to inhibit all aperture electrodes from transferring said toner.

3. The image forming apparatus according to claim 1, wherein said back electrode control means reverses the potential difference between said back electrode and said toner supply means when said electrode driving means functions to inhibit all said aperture electrodes from transferring said toner.

4. The image forming apparatus according to claim 1, wherein said back electrode control means sets the potential difference between said back electrode and said toner supply means to a predetermined voltage when said electrode driving means functions to allow at least one aperture electrode to transfer said toner.

5. The image forming apparatus according to claim 1, further comprising active electrode counting means for determining the number of driven aperture electrodes, wherein the potential difference between the back electrode and said toner supply means is varied continuously according to the determined number of driven aperture electrodes.

6. A method for controlling an electric potential applied to a back electrode to avoid unintentional transfer of toner from a toner supply device to an image recording medium, comprising the steps of:

reading a next line of image data;

determining if at least one image pixel is to be formed on the image recording medium based on the read next line of image data;

applying at least a first electric potential to the back electrode if at least one image pixel is to be formed;

applying a second electric potential to the back electrode if no image pixel is to be formed; and supplying charged toner particles from the toner supply device, wherein no toner particles are transferred to the image recording medium when the second electric potential is applied to the back electrode.

7. The method of claim 6, wherein, when the toner particles are negatively charged, the first electric potential is positive and the second electric potential is zero.

8. The method of claim 6, wherein, when the toner particles are negatively charged, the first electric potential is positive, and the second electric potential is negative.

9. The method of claim 6, wherein, when the toner particles are positively charged, the first electric potential is negative, and the second electric potential is zero.

10. The method of claim 6, wherein, when the toner particles are positively charged, the first electric potential is negative and the second electric potential is positive.

11. A method for controlling an electric potential applied to a back electrode to avoid unintentional transfer of toner from a toner supply device to an image recording medium, comprising the steps of:

reading a next line of image data;

determining a number of image pixels to be formed on the image recording medium based on the read next line of image data;

applying a first electric potential to the back electrode if no image pixels are to be formed on the image recording medium;

applying a second electric potential to the back electrode if at least a predetermined number of image pixels are to be formed on the image recording medium;

applying a third electric potential between the first electric potential and the second electric potential to the back electrode if at least one image pixel, but less than the predetermined number of image pixels, are to be formed on the image recording medium; and supplying charged toner particles from the toner supply device, wherein no toner particles are transferred to non-image portions of the image recording medium.

12. The method of claim 11, wherein, when the toner particles are negatively charged, the first electric potential is zero and the second electric potential is positive.

13. The method of claim 12, wherein the third electric potential is varied continuously between the first electric potential and the second electric potential based on the determined number of image pixels to be formed.

14. The method of claim 11, wherein the predetermined number is equal to a maximum number of image pixels capable of being formed on the image recording medium for each line.

15. The method of claim 11, wherein the predetermined number is less than a maximum number of image pixels capable of being formed on the image recording medium for each line.

16. The method of claim 11, wherein, when the toner particles are negatively charged, the first electric potential is negative and the second electric potential is positive.

17. The method of claim 16, wherein the third electric potential is varied continuously between zero and the second electric potential based on the determined number of pixels to be formed.

18. The method of claim 11, wherein, when the toner particles are positively charged, the first electric potential is zero, and the second electric potential is negative.

19. The method of claim 18, wherein the third electric potential is varied continuously between the first electric potential and the second electric potential based on the determined number of image pixels to be formed.

20. The method of claim 11, wherein, when the toner particles are positively charged, the first electric potential is positive and the second electric potential is negative.

21. The method of claim 20, wherein the third electric potential is varied continuously between zero and the second electric potential based on the determined number of image pixels to be formed.

* * * * *